US006617300B2

(12) United States Patent
Capeci et al.

(10) Patent No.: US 6,617,300 B2
(45) Date of Patent: Sep. 9, 2003

(54) GRANULAR BLEACH ACTIVATORS HAVING IMPROVED SOLUBILITY PROFILES

(75) Inventors: Scott William Capeci, North Bend, OH (US); Michael Steven Gibson, Cincinnati, OH (US); Victoria Ann Majerczak, Cincinnati, OH (US)

(73) Assignee: Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/943,179

(22) Filed: Aug. 30, 2001

(65) Prior Publication Data

US 2002/0052303 A1 May 2, 2002

Related U.S. Application Data

(60) Provisional application No. 60/228,988, filed on Aug. 30, 2000.

(51) Int. Cl.[7] ..... C11D 7/26; C11D 7/32; C11D 7/54

(52) U.S. Cl. ..... 510/311; 510/312; 510/313; 510/375; 510/376; 510/445; 510/446; 510/451; 510/500; 510/501

(58) Field of Search ..... 510/311, 312, 510/313, 375, 376, 445, 446, 451, 500, 501

(56) References Cited

U.S. PATENT DOCUMENTS

| | | | | |
|---|---|---|---|---|
| 2,220,099 | A | | 11/1940 | Guenther et al. |
| 2,477,383 | A | | 7/1949 | Lewis |
| 3,159,581 | A | | 12/1964 | Diehl |
| 3,213,030 | A | | 10/1965 | Diehl |
| 3,308,067 | A | | 3/1967 | Dehl |
| 3,400,148 | A | | 9/1968 | Quimby |
| 3,400,176 | A | | 9/1968 | Quimby |
| 3,422,021 | A | | 1/1969 | Roy |
| 3,422,137 | A | | 1/1969 | Quimby |
| 3,664,961 | A | | 5/1972 | Norris |
| 3,812,044 | A | | 5/1974 | Connor et al. |
| 3,919,678 | A | | 11/1975 | Penfold |
| 3,936,537 | A | | 2/1976 | Baskerville, Jr. et al. |
| 4,144,226 | A | | 3/1979 | Crutchfield et al. |
| 4,222,905 | A | | 9/1980 | Cockrell, Jr. |
| 4,239,659 | A | | 12/1980 | Murphy |
| 4,246,495 | A | | 1/1981 | Pressman |
| 4,444,674 | A | | 4/1984 | Gray |
| 4,483,778 | A | | 11/1984 | Thompson et al. |
| 4,486,327 | A | | 12/1984 | Murphy et al. |
| 4,663,071 | A | | 5/1987 | Bush et al. |
| 4,704,233 | A | | 11/1987 | Hartman et al. |
| 4,762,645 | A | | 8/1988 | Tucker et al. |
| 4,966,723 | A | | 10/1990 | Hodge et al. |
| 5,795,854 | A | * | 8/1998 | Angell et al. ..... 510/312 |
| 5,891,828 | A | | 4/1999 | Oka et al. |
| 5,891,838 | A | * | 4/1999 | Angell et al. ..... 510/312 |
| 5,902,781 | A | * | 5/1999 | Painter ..... 510/220 |
| 6,080,711 | A | * | 6/2000 | Brouwer et al. ..... 510/324 |
| 6,288,016 | B1 | * | 9/2001 | Ramanan et al. ..... 510/357 |
| 6,358,902 | B1 | * | 3/2002 | Angell et al. ..... 510/313 |
| 6,358,911 | B1 | * | 3/2002 | Metzger-Groom ..... 510/446 |

FOREIGN PATENT DOCUMENTS

| | | |
|---|---|---|
| WO | WO 92/06154 A1 | 4/1992 |
| WO | WO 01/46372 A2 | 6/2001 |

OTHER PUBLICATIONS

Gotoh et al., *Powder Technology Handbook*, pp. 6–11, Meral Dekker 1997.

* cited by examiner

*Primary Examiner*—Gregory Delcotto
(74) *Attorney, Agent, or Firm*—James F. McBride; Kim W. Zerby; Steve W. Miller

(57) ABSTRACT

A granular bleach activator extrudate that has a size and shape that is within a relatively narrow distribution range. The bleach activator exhibits improved solubility, and reduced product separation when incorporated into a granular detergent composition. Also provided are granular detergent compositions comprising a detersive surfactant and the bleach activator extrudates. Methods for forming the extruded bleach activator particles are also provided.

11 Claims, No Drawings

GRANULAR BLEACH ACTIVATORS HAVING IMPROVED SOLUBILITY PROFILES

CROSS REFERENCE TO RELATED APPLICATION

This patent application claims the benefit of U.S. Provisional Application Serial No. 60/228,988 filed Aug. 30, 2000 by Capeci et al.

TECHNICAL FIELD

The present invention relates to granular bleach activators having improved solubility profiles for use in detergent and textile treatment applications.

BACKGROUND OF THE INVENTION

Recently, there has been considerable interest within the detergent industry concerning laundry detergents that have the convenience, aesthetics and solubility of liquid laundry detergent products, but that retain the cleaning performance and cost of granular detergent products especially those with bleach activators. The problems, however, associated with past granular compositions with regard to aesthetics, solubility and user convenience are formidable. Such problems have been exacerbated by the advent of "compact" or low dosage granular products that typically do not dissolve rapidly in washing solutions. These low dosage granular products are currently in high demand as they conserve resources and can be sold in small packages which are more convenient for consumers prior to use, but which are less convenient when dispensed into the washing machine as compared to liquid laundry products that are simply poured directly from the bottle.

Low dosage or "compact" laundry products containing bleach activators unfortunately experience dissolution problems, especially in cold temperature laundering solutions (i.e., less than about 30° C.). More specifically, poor dissolution results in the formation of "clumps" which appear as solid white masses remaining in the washing machine or on the laundered clothes after conventional washing cycles. These "clumps" are especially prevalent under cold temperature washing conditions and/or when the order of addition to the washing machine is laundry detergent first, clothes second and water last (commonly known as the "Reverse Order Of Addition" or "ROOA"). Such undesirable "clumps" also form if the consumer loads the washing machine in the order of: clothes, detergent and then water.

This clumping phenomenon can contribute to the incomplete dispensing of granular laundry products in washing machines equipped with dispenser drawers or in other dispensing devices, such as a granulette. In this case, the undesired result is undissolved detergent and bleach activator residue in the dispensing device.

Granular bleach activators are commonly used in combination with detersive surfactants and detergent builders in various detergent compositions. In such compositions, it has been found that the cause of the aforementioned dissolution problem is associated with the "bridging" of a "gel-like" substance between surfactant-containing particles to form undesirable "clumps." The gel-like substance responsible for the undesirable bridging of particles into clumps originates from the partial dissolution of surfactant in the aqueous laundering solutions, wherein such partial dissolution causes the formation of a highly viscous surfactant phase or paste which binds or otherwise bridges other surfactant-containing particles together into clumps. This undesirable dissolution phenomena is commonly referred to as "lump-gel" formation.

In addition to the viscous surfactant bridging effect, inorganic salts have a tendency to hydrate which can also cause bridging of particles which are linked together via hydration. In particular, inorganic salts hydrate with one another to form a cage structure which exhibits poor dissolution and ultimately ends up as a clump after the washing cycle. It would therefore be desirable to have a detergent composition that does not experience the dissolution problems identified above so as to result in improved cleaning performance.

The prior art is replete with disclosures addressing the dissolution problems associated with granular detergent compositions containing bleach activator particles. For example, the prior art suggests limiting the use and manner of inorganic salts that can cause clumps via the bridging of hydrated salts during the laundering cycle. Specific ratios of selected inorganic salts are contemplated so as to minimize dissolution problems. Such a solution, however, constricts the formulation and process flexibility that is necessary for current commercialization of large-scale detergent products. Various other mechanisms have been suggested by the prior art, all of which involve formulation alteration, and thereby reduce formulation flexibility. As a consequence, it would therefore be desirable to have a detergent composition having improved dissolution without significantly inhibiting formulation flexibility. Accordingly, there remains a need to identify a mechanistic approach to the performance of granular detergent compositions and their granular components over a broad range of conditions and for a granular composition that has improved dispersion and solubility over conventional granular detergent and compositions. The identification and controlled production of granular bleach activators that will contribute to such improvements in dispersion and solubility without constricting formulation flexibility are essential.

A further problem associated with granular detergents is the separation of detergent components during transport and storage prior to use. This separation is largely due to the presence of different detergent components that have different sizes, shapes and weight. Over time and through movements or vibration of the composition, smaller, heavier components tends to settle towards the bottom of the detergent container. This separation of the detergent composition components can result in the consumer dispensing a composition which no longer contains the intended detergent formulation. The prior art has attempted to overcome this problem by combining all of the detergent components in a single particle or agglomerate that cannot separate, but many of these components are reactive and tend to degrade when combined in this manner. Thus, there remains a need for a detergent composition wherein the granular components are of a relatively uniform size and shape to thereby inhibit this separation effect.

Still yet another problem associated with the formation of bleach activator granules is in production of extruded granules or particulates that have a relatively uniform size, and shape. Typically, bleach activators are extruded and then ground to an approximate size. However, grinding is a inexact process and it tends to produce copious amounts of fines and overs that must be separated from the target sized granules and recycled or otherwise handled. Thus, there also remains a need for a process that will enable the production of bleach activators having uniform size and shape that are selected by the formulator.

Granular bleach activators may also be used in various processes in the production of textiles. Although the dissolution problems that are believed to be associated with the presence of detersive surfactants and inorganic salts may not be present in such applications, the availability of a granular bleach activator extrudate having uniform physical and performance characteristics, including good solubility, is also highly desired.

SUMMARY OF THE INVENTION

In accordance with one aspect of the invention, a cylindrically-shaped bleach activator extrudate having uniform length and diameter are provided. The bleach activators have the general formula:

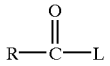

wherein R is an alkyl group containing from about 5 to about 18 carbon atoms wherein the longest linear alkyl chain extending from and including the carbonyl carbon contains from about 6 to about 12 carbon atoms and L is a leaving group, the conjugate acid of which has a pK$\alpha$ in the range of from about 6 to about 13, and wherein said bleach activator is in the form of a cylindrically-shaped particle having a mean particle diameter of from about 450 microns to about 1000 microns and a mean extrudate length of from about 450 microns to about 3500 microns. The cylindrically-shaped bleach activator extrudate has improved solubility, flowability and reduced product settlement or separation when mixed with other granular materials, such as in a granular detergent composition.

In a further aspect of the present invention, a granular detergent composition containing a cylindrically-shaped bleach activator having a uniform diameter and length is provided. The granular detergent composition contains a particulate detersive surfactant, particulate detergent builder and an effective amount of cylindrically-shaped bleach activator granules, wherein the bleach activator granules have substantially the same diameter and length as the particulate surfactant and builder. The granular detergent composition exhibits improved solubility, flowability and reduced product settlement during storage. Accordingly, it is an object of the invention to provide a detergent composition containing bleach activator particles that have good stability prior to use and acceptable physical properties.

In accordance with a process aspect of the invention, a method of extruding bleach activators so as to produce granules having uniform diameter and length is provided. The method comprises the steps of passing the bleach activator material through a heated die having a desired diameter and shape, cutting the extrudate at a desired frequency, and rapidly cooling the cut extrudate.

These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENTS

Following the conventional definition of a cylinder, the phrase "cylindrically-shaped extrudates" means an extruded particle having a surface shape generated by a straight line moving parallel to a fixed straight line and intersecting a fixed planar closed curve. The cylindrical shape is typically derived from the internal surfaces of an extrusion die through which the extrudate is formed. Clearly, it is anticipated that extrusion dies having different internal configurations may be used to produce extrudates having different shapes and/or diameters.

As used herein, "free water" level means the level on a percentage by weight basis of water in the bleach activator extrudate or detergent composition, that is not bound up in another detergent ingredient such as zeolite; it is the water level in excess of any water entrained in, adsorbed in, or otherwise bound up in other detergent ingredients.

As used herein, the word "particles" means the entire size range of bleach activator before it might be incorporated into a final detergent product or component or the entire size range of discrete particles, agglomerates, or granules in a final detergent product or component admixture. It specifically does not refer to a size fraction (i.e., representing less than 100% of the entire size range) of any of these types of particles unless the size fraction represents 100% of a discrete particle in an admixture of particles. For each type of particle component in an admixture, the entire size range of discrete particles of that type have the same or substantially similar composition regardless of whether the particles are in contact with other particles. For agglomerated components, the agglomerates themselves are considered as discrete particles and each discrete particle may be comprised of a composite of smaller primary particles and binder compositions.

As used herein, the phrase "mean extrudate diameter" means the geometric mass median diameter of a set of discrete particles as measured by any standard mass-based particle size measurement technique, preferably by optical imaging such as using an optical microscope with Optimus (V5.0) image analysis software.

As used herein, the phrase "geometric standard deviation" or "span" of a particle size distribution means the geometric breadth of the best-fitted log-normal function to the above-mentioned particle size data which can be accomplished by the ratio of the diameter of the 84.13 percentile divided by the diameter of the $50^{th}$ percentile of the cumulative distribution ($D_{84.13}/D_{50}$); See Gotoh et al, *Powder Technology Handbook,* pp. 6–11, Meral Dekker 1997.

As used herein, the term "builder" means any inorganic material having "builder" performance in the detergency context, and specifically, organic or inorganic material capable of removing water hardness from washing solutions.

As used herein, the term "bulk density" refers to the uncompressed, untapped powder bulk density, as measured by pouring an excess of powder sample through a funnel into a smooth metal vessel (e.g., a 500 ml volume cylinder), scraping off the excess from the heap above the rim of the vessel, measuring the remaining mass of powder and dividing the mass by the volume of the vessel.

All percentages and ratios used herein are expressed as percentages by weight (anhydrous basis) unless otherwise indicated. All cited documents are incorporated herein by reference.

Bleach Activators

The bleach activator for the bleaching systems useful herein can be any material that forms a per-acid in use. One class of preferred materials has the following structure:

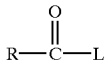

wherein R is an alkyl group containing from about 5 to about 18 carbon atoms wherein the longest linear alkyl chain extending from and including the carbonyl carbon contains from about 6 to about 12 carbon atoms and L is a leaving group, the conjugate acid of which has a pKα in the range of from about 4 to about 13, preferably from about 6 to about 11, most preferably from about 8 to about 11.

L can be essentially any suitable leaving group. A leaving group is any group that is displaced from the bleach activator as a consequence of the nucleophilic attack on the bleach activator by the perhydroxide anion. This perhydrolysis reaction, results in the formation of the percarboxylic acid. Generally, for a group to be a suitable leaving group it must exert an electron attracting effect. This facilitates the nucleophilic attach by the perhydroxide anion.

The L group must be sufficiently reactive for the reaction to occur within the optimum time frame (e.g., a wash cycle). However, if L is too reactive, this activator will be difficult to stabilize. These characteristics are generally paralleled by the pKα of the conjugate acid of the leaving group, although exceptions to this convention are known.

Preferred bleach activators are those of the general formula:

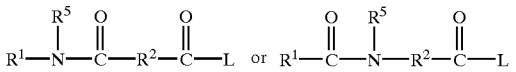

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is selected from the group consisting of:

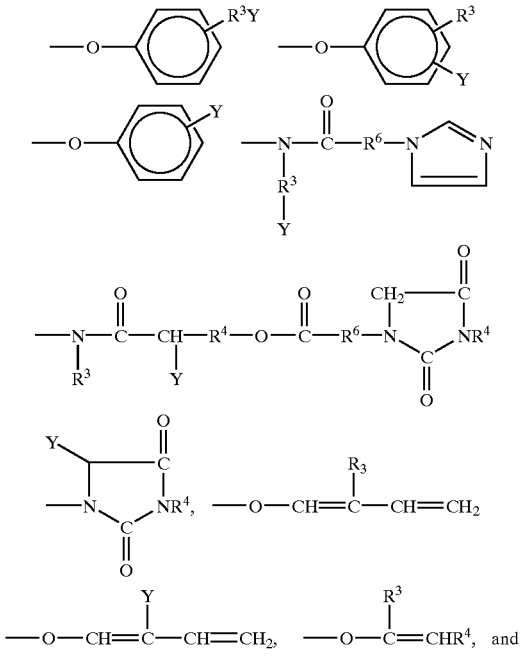

-continued

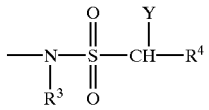

wherein $R^6$ is an alkylene, arylene, or alkarylene group containing from about 1 to about 14 carbon atoms, $R^3$ is an alkyl chain containing from about 1 to about 8 carbon atoms, $R^4$ is H or $R^3$, and Y is H or a solubilizing group. Y is preferably selected from the group consisting of $—SO_3^-M^+$, $—COO^-M^+$, $—CO_2H$, $—CO_2^-M^+$, $—SO_4^-M^+$, $(—N+R'_3)X^-$ and $O←N(R'_3)$, wherein R' is an alkyl chain containing from about 1 to about 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is an anion selected from the group consisting of halide, hydroxide, methylsulfate and acetate anions. More preferably, Y is $—SO_3^-M^+$, $—CO_2H$ and $—COO^-M^+$. It should be noted that bleach activators with a leaving group that does not contain a solubilizing group should be well dispersed in the bleach solution in order to assist in their dissolution. Preferred is:

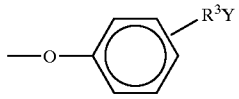

wherein $R^3$ is as defined above and Y is $—SO_3^-M^+$ or $—COO^-M^+$ wherein M is as defined above.

Especially preferred bleach activators are those wherein $R^1$ is a linear alkyl chain containing from about 6 to about 12 carbon atoms, $R^2$ is a linear alkylene chain containing from about 2 to about 6 carbon atoms, $R^5$ is H, and L is selected from the group consisting of:

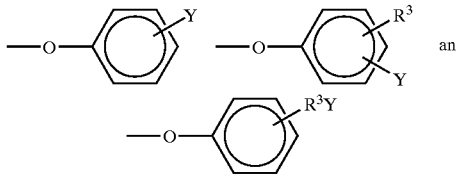

wherein $R^3$ is as defined above, Y is $—SO_3^-M^+$ or $—COO^-M^+$ and M is as defined above.

A preferred bleach activator is:

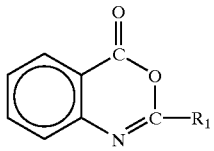

wherein $R^1$ is H, alkyl, aryl or alkaryl. This is described in U.S. Pat. No. 4,966,723, Hodge et al., incorporated by reference herein.

Preferred bleach activators are:

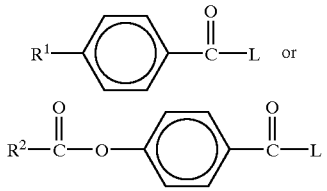

wherein $R^1$ is H or an alkyl group containing from about 1 to about 6 carbon atoms and $R^2$ is an alkyl group containing from about 1 to about 6 carbon atoms and L is as defined above.

Preferred bleach activators are also those of the above general formula wherein L is as defined in the general formula, and $R^1$ is H or an alkyl group containing from about 1 to about 4 carbon atoms. Even more preferred are bleach activators of the above general formula wherein L is as defined in the general formula and $R^1$ is a H.

More preferred bleach activators are those of the above general formula wherein R is a linear alkyl chain containing from about 5 to about 9 and preferably from about 6 to about 8 carbon atoms and L is selected from the group consisting of:

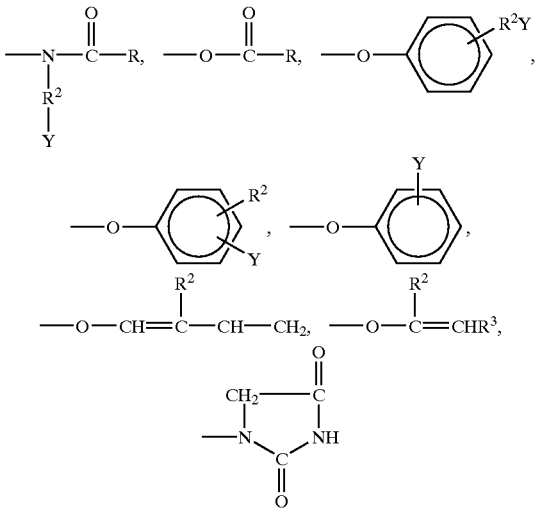

wherein R, $R^2$, $R^3$ and Y are as defined above.

Particularly preferred bleach activators are those of the above general formula wherein R is an alkyl group containing from about 5 to about 12 carbon atoms wherein the longest linear portion of the alkyl chain extending from and including the carbonyl carbon is from about 6 to about 12 carbon atoms, and L is selected from the group consisting of:

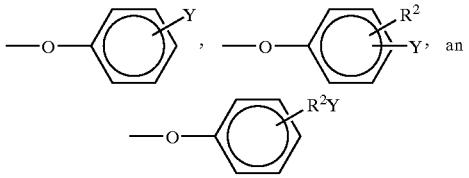

herein $R^2$ is an alkyl chain containing from about 1 to about 8 carbon atoms, and Y is $—SO_3^-M^+$ or $—COO^-M^+$ wherein M is an alkali metal, ammonium or substituted ammonium cation.

Especially preferred bleach activators are those of the above general formula wherein R is a linear alkyl chain containing from about 5 to about 9 and preferably from about 6 to about 8 carbon atoms and L is selected from the group consisting of:

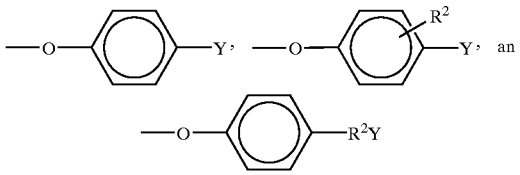

wherein $R^2$ is as defined above and Y is $—SO_3^-M^+$, $—COO^-M^+$, or $—CO_2H$, wherein M is as defined above.

The most preferred bleach activators have the formula:

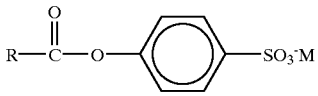

wherein R is a linear alkyl chain containing from about 5 to about 9 and preferably from about 6 to about 8 carbon atoms and M is sodium or potassium. Preferably, the bleach activator herein is sodium nonanoyloxybenzenesulfonate (NOBS), sodium benzoyloxybenzenesulfonate (BOBS), sodium lauroyloxybenzene sulfonate (LOBS) or para-decanoyloxybenzoic acid (DOBA).

Further particularly preferred for use in the present invention bleaching compositions are bleach activators which are particularly safe for use with machines having natural rubber parts. This is believed to be the result of not producing oily diacylperoxide (DAP) species by the perhydrolysis reaction of these amido acid-derived bleach activators, but rather forming insoluble crystalline solid DAP's. These solids are believed to not form a coating film and thus natural rubber parts are not exposed to DAP's for extended periods of time. These preferred bleach activators are members selected from the group consisting of:

a)a bleach activator of the general formula:

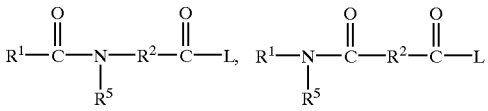

or mixtures thereof, wherein $R^1$ is an alkyl, aryl, or alkaryl group containing from about 1 to about 14 carbon atoms, $R^2$ is an alkylene, arylene or alkarylene group containing from about 1 to about 14 carbon atoms, $R^5$ is H or an alkyl, aryl, or alkaryl group containing from about 1 to about 10 carbon atoms, and L is a leaving group;

b) benzoxazin-type bleach activators of the general formula:

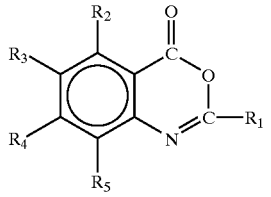

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkylamino, $COOR_6$ (wherein $R_6$ is H or an alkyl group) and carbonyl functions;

c) N-acyl caprolactam bleach activators of the formula:

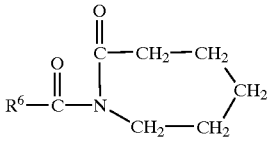

wherein $R^6$ is H or an alkyl, aryl, alkoxyaryl or alkaryl group containing from 1 to 12 carbons; and d) mixtures of a), b) and c).

Preferred bleach activators of type a) are those wherein $R^1$ is an alkyl group containing from about 6 to about 12 carbon atoms, $R^2$ contains from about 1 to about 8 carbon atoms, and $R^5$ is H or methyl. Particularly preferred bleach activators are those of the above general formulas wherein $R^1$ is an alkyl group containing from about 7 to about 10 carbon atoms and $R^2$ contains from about 4 to about 5 carbon atoms.

Preferred bleach activators of type b) are those wherein $R_2$, $R_3$, $R_4$, and $R_5$ are H and $R_1$ is a phenyl group.

The preferred acyl moieties of said N-acyl caprolactam bleach activators of type c) have the formula $R^6$—$CO^-$ wherein $R^6$ is H or an alkyl, aryl, alkoxyaryl, or alkaryl group containing from 1 to 12 carbons, preferably from 6 to 12 carbon atoms. In highly preferred embodiments, $R^6$ is a member selected from the group consisting of phenyl, heptyl, octyl, nonyl, 2,4,4-trimethylpentyl, decenyl and mixtures thereof.

Amido Derived Bleach Activators

The bleach activators of type a) employed in the present invention are amide substituted compounds of the general formulas:

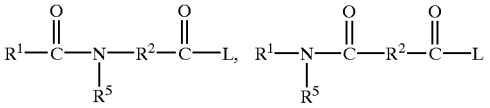

or mixtures thereof, wherein $R^1$ $R^2$ and $R^5$ are as defined above and L can be essentially any suitable leaving group. Preferred bleach activators are those of the above general formula wherein $R^1$, $R^2$ and $R^5$ are as defined for the peroxyacid and L is selected from the group consisting of:

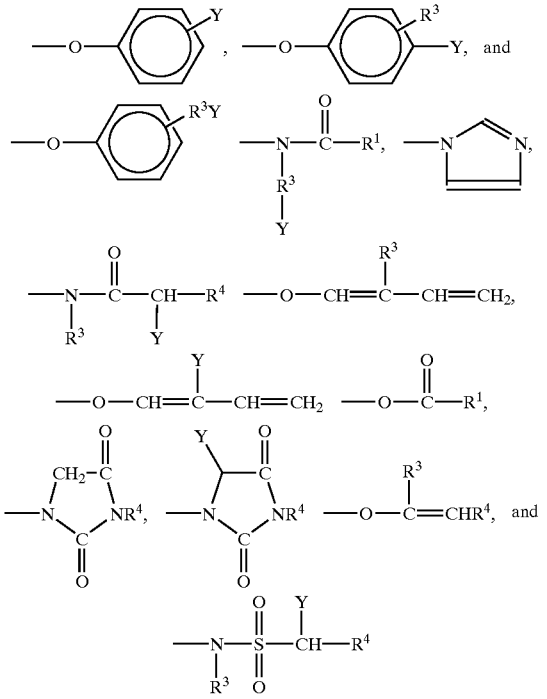

and mixtures thereof, wherein $R^1$ is an alkyl, aryl, or alkaryl group containing from about 1 to about 14 carbon atoms, $R^3$ is an alkyl chain containing from 1 to about 8 carbon atoms, $R^4$ is H or $R^3$, and Y is H or a solubilizing group.

The preferred solubilizing groups are $—SO_3^-M^+$, $—CO_2^-M^+$, $—SO_4^-M^+$, $—N^+(R^3)_4X^-$ and $O←N(R^3)_3$ and most preferably $—SO_3^-M^+$ and $—CO_2^-M^+$ wherein $R^3$ is an alkyl chain containing from about 1 to about 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion. It should be noted that bleach activators with a leaving group that does not contain a solubilizing groups should be well dispersed in the bleaching solution in order to assist in their dissolution.

Preferred bleach activators are those of the above general formula wherein L is selected from the group consisting of:

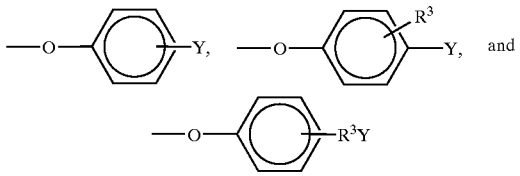

wherein $R^3$ is as defined above and Y is $—SO_3^-M^+$, $—CO_2^-M^+$, or $—CO_2H$, wherein M is as defined above.

Another important class of bleach activators, including those of type b) and type c), provide organic peracids as described herein by ring-opening as a consequence of the nucleophilic attack on the carbonyl carbon of the cyclic ring by the perhydroxide anion. For instance, this ring-opening reaction in type c) activators involves attack at the caprolactam ring carbonyl by hydrogen peroxide or its anion.

Since attack of an acyl caprolactam by hydrogen peroxide or its anion occurs preferably at the exocyclic carbonyl, obtaining a significant fraction of ring-opening may require a catalyst. Another example of ring-opening bleach activators can be found in type b) activators, such as those disclosed in U.S. Pat. No. 4,966,723, Hodge et al, issued Oct. 30, 1990.

Benzoxazin-Type Bleach Activators

Such activator compounds disclosed by Hodge include the activators of the benzoxazin-type, having the formula:

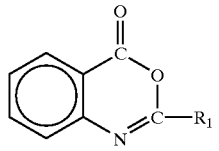

including the substituted benzoxazins of the type

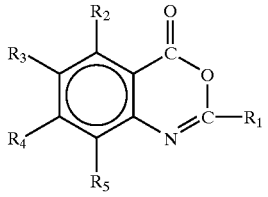

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

A preferred activator of the benzoxazin-type is:

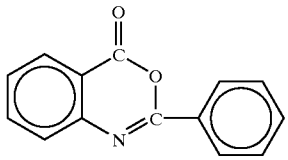

When the activators are used, optimum surface bleaching performance is obtained with washing solutions wherein the pH of such solution is between about 8.5 and 10.5 and preferably between 9.5 and 10.5 in order to facilitate the perhydrolysis reaction. Such pH can be obtained with substances commonly known as buffering agents, which are optional components of the bleaching systems herein.

N-Acyl Caprolactam Bleach Activators

The N-acyl caprolactam bleach activators of type c) employed in the present invention have the formula:

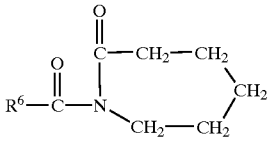

wherein $R^6$ is H or an alkyl, aryl, alkoxyaryl, or alkaryl group containing from 1 to 12 carbons. Caprolactam activators wherein the $R^6$ moiety contains at least about 6, preferably from 6 to about 12, carbon atoms provide hydrophobic bleaching which affords nucleophilic and body soil clean-up, as noted above. Caprolactam activators wherein $R^6$ comprises from 1 to about 6 carbon atoms provide hydrophilic bleaching species which are particularly efficient for bleaching beverage stains. Mixtures of hydrophobic and hydrophilic caprolactams, typically at weight ratios of 1:5 to 5:1, preferably 1:1, can be used herein for mixed stain removal benefits.

Highly preferred N-acyl caprolactams are selected from the group consisting of benzoyl caprolactam, octanoyl caprolactam, nonanoyl caprolactam, 3,5,5-trimethylhexanoyl caprolactam, decanoyl caprolactam, undecenoyl caprolactam, and mixtures thereof. Methods for making N-acyl caprolactams are well known in the art.

Additional species of suitable bleach activators are disclosed in U.S. Pat. Nos. 5,795,854 and 5,891,828, issued Aug. 18, 1998 and Apr. 6, 1999 respectively, to Angell et al., which is hereby incorporated by reference.

Also suitable as bleach activators are the various classes of esters, imides, imidazoles, oximes and carbonate bleach precursor compounds disclosed in U.S. Pat. No. 4,444,674, issued Apr. 24, 1984, to Gray et al., which is hereby incorporated by reference. The imide tetraacetylethylenediamine is one notable example.

Binder Materials

The bleach activator particle may also comprise binder materials which not only provide cohesion to the activator particles but also stabilize the bleach activator material during storage by preventing reactions between the activator material and other formula components that may be present as well as with ambient moisture.

The materials that can be utilized as binder materials are nonionic surfactants, polyethylene glycols, fatty acids, anionic surfactants, inorganic and organic salts, film forming polymers, chelants, cationic surfactants, polymeric disintegrating agents and mixtures of these materials. A preferred set of binder materials are nonionic surfactants, polyethylene glycols, fatty acids, anionic surfactants, inorganic salts, film forming polymers and mixtures of these materials. It is preferred that they are selected so as to not be reactive with the bleach activators of the present invention or the components of the detergent compositions into which the bleach activator particles are blended. Generally, these binder materials should have a low hygroscopicity upon storage but should be soluble or dispersable in water, which allows for the ready dispersion and release of the peroxygen bleach activator in an aqueous solution. It is also desirable that the employed binder or enrobing materials do not melt below about 40° C. because frequently the storage temperature for detergent products containing such bleach activators may reach as high as 40° C.

Examples of nonionic surfactants that can be utilized as binder materials are the condensation products of primary or secondary aliphatic alcohols having from 8 to 24, and preferably about 9 to about 18, carbon atoms, in either a straight or branched chain configuration, with from about 35 to about 100 moles, and preferably about 40 to about 80 moles, of ethylene oxide per mole of alcohol. Additional examples of nonionic surfactant suitable for use as binders are disclosed in U.S. Pat. No. 4,483,778, issued Nov. 20, 1984, to Thompson et al, which is hereby incorporated by reference.

Suitable polyethylene glycols are homopolymers of ethylene oxide have the general formula:

$$HO(C_2H_4O)_nH,$$

and have an average molecular weight of from about 2,000 to about 15,000, preferably from about 3,000 to about 10,000 and most preferably from about 4,000 to about 8,000.

The fatty acids suitable for use in the extrudates of the present invention include the saturated fatty acids having the formula:

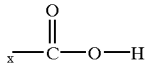

wherein $R_x$ is an alkyl group which contains less than 15, preferably less than about 11, more preferably less than about 9 carbon atoms. It is preferred that the extrudate contain no saturated fatty acids of the above formula wherein $R_x$ contains more than 15 carbon atoms.

Generally, fatty acids always form part of the binder material composition when it is desired to use polyethylene glycols. This is because fatty acids lower the glass transition temperature (the temperature at which a liquid solidifies into a short-range order solid, such as a glass or amorphous solid) and so act to keep the polyethylene glycol in a viscoelastic state. The fatty acids can also be useful for lowering the pH of the particle to discourage hydrolysis. However, it is also believed that the longer chain fatty acids are partly responsible for the poor dispersability and solubility performance frequently seen in poor dissolving granular laundry detergents. Accordingly, when used, it is an essential part of the present invention that the fatty acids be selected based on the maximum alkyl chain length described above.

Suitable anionic surfactants useful as binder materials in the extrudates of the present invention include the water-soluble salts, preferably the alkali metal, ammonium and alkylolammonium salts, of organic sulfuric reaction products having in their molecular structure an alkyl group containing from about 8 to about 20 carbon atoms and a sulfonic or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms), and the sodium and potassium alkylbenzene sulfonates in which the alkyl group contains from about 9 to about 15 carbon atoms in a straight or branched chain configuration. These are described in U.S. Pat. Nos. 2,220,099 and 2,477,383, both incorporated herein by reference. The preferred anionic surfactants are linear straight chain alkylbenzene sulfonates in which the average number of carbon atoms in the alkyl group is from about 11 to 13, abbreviated as $C_{11-13}$ LAS. Additional examples of anionic surfactant suitable for use as binders are disclosed in U.S. Pat. No. 4,444,674, incorporated above.

Also suitable as components of the binder material are the organic and inorganic salts such as acetates, alkali salts of maleic acid, citrates, aluminosilicates, sulfates, carbonates, hydrogen phosphates, pyrophosphates, tetraborates, thiosulfates and mixtures thereof. Inorganic salts are preferred and particularly preferred are sodium and magnesium sulfate salts. These salts are particularly useful when water is a component of the binder material because by incorporating free water into their crystal structure they reduce the amount of free water in the bleach activator particle and the overall detergent composition. As discussed in greater detail below, free water can contribute to bleach activator instability.

Suitable film forming polymers useful as binder materials in the extrudates of the present invention are the polymers derived from the monomers such as vinyl chloride, vinyl alcohol, furan, acrylonitrile, vinyl acetate, methyl acrylate, methyl methacrylate, styrene, vinyl methyl ether, vinyl ethyl ether, vinyl propyl ether, acrylamide, ethylene, propylene and 3-butenoic acid. Preferred polymers of the above group are the homopolymers and copolymers of acrylic acid, hydroxyacrylic acid, or methacrylic acid, which in the case of the copolymers contain at least about 50%, and preferably at least about 80%, by weight, units derived from the acid. The particularly preferred polymer is sodium polyacrylate. Other specific preferred polymers are the homopolymers and copolymers of maleic anhydride, especially the copolymers with ethylene, styrene and vinyl methyl ether. These polymers are commercially available under the trade names Versicol and Gantrez. Other film-forming polymers useful as binder or enrobing materials in the extrudates of the present invention are disclosed in U.S. Pat. No. 4,486,327, incorporated above.

The binder material may also optionally comprise one or more chelating agents. Such chelating agents can be selected from the group consisting of amino carboxylates, amino phosphonates, polyfunctionally-substituted aromatic chelating agents and mixtures therein, all as hereinafter defined.

Amino carboxylates useful as optional chelating agents include ethylenediaminetetrace-tates, N-hydroxyethylethylenediaminetriacetates, nitrilo-tri acetates, ethylenediamine tetrapropionates, triethylenetetraaminehexacetates, diethylenetriaminepentaacetates, and ethanoldiglycines, alkali metal, ammonium, and substituted ammonium salts thereof and mixtures thereof.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferably, these amino phosphonates do not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor, et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder. Similarly, the so called "weak" builders such as citrate can also be used as chelating agents.

The binder material may also comprise polymeric disintegrating agents which are capable of accelerating the dissolution of the bleach activator material. In a preferred embodiment, the disintegrating agent comprises a polymeric material which is a so called water-swellable polymer, capable of absorbing water and increasing thereby its volume. It may thus be preferred that the disintegrating agent is only partially water soluble or substantially not water soluble.

The disintegrating agent comprises preferably one or more polymers selected from the group comprising cross-linked polymers of polyvinyl pyrrolidone, cross-linked copolymers of polyvinyl pyrrolidone, starch, modified starch, including pregelatinised starch and sodium starch gluconate, gum, cellulose, modified cellulose, preferably cross-linked cellulose, cross-linked cellulose derivatives, hydroxyalkyl cellulose, microcrystalline cellulose, microcrystalline cellulose derivatives, microcrystalline crosslinked cellulose, compacted cellulose, compacted modified cellulose such as compacted cellulose derivatives or compacted cross-linked cellulose, or mixtures thereof.

Processes for Making the Bleach Activator Extrudates

In the first step for producing bleach activator extrudates, and when a binder material is to be used, the above described activator and binder materials are thoroughly mixed together in a lab scale mixer such as Cuisinart® or in conventional industrial scale mixers such as a Lödige CB mixer, Bepex Tubolizer®, or similar type mixer to form an activator/binder mixture. Depending on the desires of the formulator, the mixture may or may not be heated during mixing.

The resulting binder/activator mixture is sufficiently densified that it can be subjected to an extrusion process. The production of activator particles by extrusion is specifically discussed in U.S. Pat. No. 4,486,327, incorporated above.

Thus, in a second step, the activator material is forced through an orifice in a die plate in an extruder (preferably a screw-type extruder) to produce long strands of bleach activator-containing material that is sufficiently plasticized to be easily cut into extrudates. When a polyethylene glycol and a fatty acid are the base components of the binder material, it may be necessary to heat the activator/binder mixture before extrusion.

After extruding the bleach activator material, the extrudate strands are cooled and cut at regular intervals. The size and shape of the extrudates is accomplished through the choice of die plate and through the controlled cutting of the extrudate. Sizing of the extrudate may be achieved by grinding as well, but grinding provides minimal control over the size and shape of the product.

The cutting means used to cut the extrudate at regular intervals can be a knife or is preferably a wire cutter that periodically cuts the strands at a desired frequency rate in close proximity to the die plate. Alternatively, the cutting means may also comprise a device wherein the extrudate strands are laid down on a conveyor belt and are cut at regular intervals by a series of knives. In an embodiment of this device, a second belt having the knives arranged along its length is arranged above the extrudate product belt. The two belts are synchronized so that as extrudate product is laid down the knives cut the extrudate at desired intervals. In an alternative embodiment, the series of knives may be attached to a rotation device that is synchronized with the movement of the extrudate product belt so that as the extrudate laid down it is cut into regular lengths by the rotating knives.

The cooling of the extrudates will preferably be accomplished by contacting or immersing the extrudates in a cold fluid, preferably a gas maintained at very low or even cryogenic temperatures. The exposure of the extrudate to cryogenic temperatures causes a quench cooling of extruded particle. Not to be limited by theory, but it is believed that the rapid or quench cooling of the extruded particles renders them less crystalline such that they will more rapidly dissolve in aqueous solutions.

Extrusion equipment that may be used to extrude the bleach activator material, and cut and cool the extrudate is commercially available from CDL Technology, Inc. Addison, Ill.

When water and an inorganic salt (e.g. sulfate) are the base components of the binder material, the resulting friction and dissipation of mechanical energy during extrusion of the activator/binder mixture will cause an increase in the temperature of the die plate which will in turn cause evaporation of some of the water content of the activator/binder material. To reduce the water content further it may even be desirable to heat the die plate to a temperature above or significantly above the hydration temperature of the inorganic salt in the activator/binder mixture (where it is assumed most of the water is located). The activator/binder mixture is then cooled, dried (optionally), and cut or ground into extrudates. When desired, drying may take place at a high temperature to eliminate as much of the water of hydration from the inorganic salt as possible. By this latter step, the inorganic salts may be at least partially "dehydrated"—that is coordination locations for forming water ligands in the crystal structure may be made available so that during storage of the activator particles, the inorganic salts may serve as "sinks" to absorb moisture from the atmosphere or the other particles in the granular product, thus providing further stabilizing benefits to the bleach activator particle.

Optionally, a finely divided inorganic powder may be added as a flow aid to the surface of the extrudates to yield acceptable flow properties for bulk handling of the extrudates. This flow aid includes, but is not limited to, finely divided aluminosilicates, silicas, crystalline layered silicates, MAP zeolites, amorphous silicates, sodium carbonate, and mixtures thereof. It is preferable for the level of the flow aid to be from about 0.1% to about 10%, more preferably from about 1% to about 7%, and most preferably from about 1.5% to about 5% by weight of the detergent composition. The most preferable flow aid is aluminosilicate.

Morphology, Size, Composition and Usage of the Bleach Activator Particles

Preferably the bleach activator extrudates prepared according to the present invention will be substantially cylindrical in shape. These cylindrically-shaped extrudates have a mean extrudate length of from about 450 microns to about 3500 microns, more preferably from about 450 microns to about 3000 microns, and most preferably from about 450 microns to about 2500 microns. Preferably, the mean extrudate diameter is from about 450 microns to about 1000 microns, more preferably from about 500 microns to about 950 microns, and most preferably from about 550 microns to about 850 microns. The advantages of the cylindrical morphology and the advantages of the above-specified particle sizes as well as techniques for obtaining average diameter and length measurements are disclosed in the U.S. Pat. No. 5,795,854, incorporated above.

In the present invention the bleach activator particles will comprise from about 5% to about 50%, preferably from about 4% to about 30%, and more preferably from about 1% to about 15% of the binder material and from about 50% to about 95%, preferably from about 60% to about 85% of the bleach activator. Typically the binder material will be composed of water and an inorganic salt plus other components, or it will be composed of polyethylene glycols and fatty acids (as described above) plus other components; it is undesirable to include water, inorganic salts, polyethylene glycols and fatty acids all in the same binder material.

When the bleach activator extrudate is used, as will be most typical, in a laundry detergent composition, it is preferable that the detergent composition contain less than about 3%, more preferably less than about 2.5%, and most preferably less than about 2% by weight of free water. While not wishing to be bound by theory, it is believed that by maintaining this relatively low level of free water in the composition, the propensity of the bleach activator to degrade via hydrolysis prior to use is reduced. Thus, the stability of the bleach activator is enhanced and prolonged even further as a result of a selected free water level as set forth herein. Likewise, the bleach activator particle itself should not contain more than about 2% water.

In a highly preferred embodiment of the invention, the bleach activator extrudates comprise, by weight of the extruded particle, from about 70% to about 95% of a bleach activator, from about 0.1% to about 15% of an inorganic salt, and less than 2% water. This formulation has been shown to both maintain the stability of the bleach activator while also encouraging dispersion and dissolution when added to an aqueous liquor. Although this formulation contains water, most of this water is probably not free water but rather is present as bound water in the crystal lattice of the inorganic salt.

In another highly preferred embodiment of the invention, the bleach activator extrudates comprise, by weight of the extruded particle, from about 65% to about 95% of a bleach activator, from about 0.1% to about 15% of polyethylene glycol, and from about 0.1% to about 5% of fatty acids as described above, wherein the fatty acids contain less than 16 carbon atoms, preferably less than 11 carbon atoms, and more preferably less than 10 carbon atoms. This formulation also has been shown to both maintain the stability of the bleach activator while also encouraging dispersion and dissolution.

Detergent compositions prepared according to the present invention will contain from about 0.01% to about 40%, preferably from about 1% to about 25%, more preferably from about 2% to about 10% of the bleach activator particles described herein.

The granular bleach activators of the present invention provide the desired benefits of solubility, improved aesthetics and flowability via the selection of an optimal uniform size and shape.

By "improved aesthetics", it is meant that the consumer prefers a granular product that has a more uniform appearance of particles as opposed to past granular detergent and bleach activators that contained particles of varying size and composition. To that end, at least about 50%, more preferably at least about 75%, even more preferably at least about 90%, and most preferably at least about 95%, by weight of the total particles in the bleach activator product, have the selected mean particle size diameter. Furthermore, at least about 50%, more preferably at least about 75%, even more preferably at least about 90%, and most preferably at least about 95%, by weight of the total particles in the bleach activator product, have the selected mean particle size length. In this way, a substantial portion of the granular product will have the uniform size and shape so as to provide the aesthetic appearance desired by consumers.

When incorporated into a granular detergent composition, it is most preferred that the size and shape of the bleach activator granules approximate the size and shape of the other components in the composition.

Preferably, the length distribution is defined by a relatively tight geometric standard deviation or "span" so as not to have too many particles outside of the target length. Accordingly, the geometric standard deviation is preferably is from about 1 to about 1.4, more preferably is from about 1.0 to about 1.3, and most preferably is from about 1.0 to about 1.2. Also, the mean extrudate length can be defined by the aspect ratio, the ratio of the mean extrudate length to the mean extrudate diameter. The aspect ratio is preferably less than about 2.0, more preferably less than about 1.7, even more preferably less than about 1.4 and most preferably less than about 1.3.

Having the aspect ration and length distribution within the preferred range provides a more aesthetically appealing product for the consumer. It also provides further advantages to the cylindrical morphology and particle size as are disclosed in U.S. Pat. No. 5,795,854, incorporated above, particularly in segregation potential and solubility.

The average bulk density of the particles is preferably at least about 450 g/l, more preferably at least about 550 g/l, and most preferably at least about 650 g/l.

While not intending to be bound by theory, it is believed that solubility of the bleach activator granules and of compositions incorporating the granules is enhanced as a result of the particles being more of the same size. Specifically, as a result of the particles being more uniform in size and shape, the actual "contact points" among the particles in the detergent composition is reduced which, in turn, reduces the "bridging effect" commonly associated with the "lump-gel" dissolution difficulties in granular detergent compositions that incorporate bleach activators. Previous granular detergent compositions contained particles of varying sizes which leads to more contact points among the particles. For example, a large particle could have many smaller particles in contact with it rendering the particle site ripe for lump-gel formation. The level and uniform sized particles of the present invention avoids such problems.

Alternatively, improvements in the solubility of granular bleach activators may be satisfied via a more standard or uniform shape of the individual particles of the granular detergent. A more uniform shape leads to more uniform dispersion and a reduction in the contact points between particles as discussed above. Shape can be measured in a number of different ways known to those of ordinary skill in the art. One such method is using optical microscopy with Optimus (V5.0) image analysis software.

Detergent Compositions

The bleach activator granules of the present invention may be incorporated into granular detergent compositions that are formulated with a varying array of ingredients and properties to achieve the overall superior solubility. Typically, at least some particles in a granular detergent composition contain detersive surfactant to provide the fundamental building blocks of a typical detergent composition. The various surfactants and detergent builders as well as their respective levels in the composition are set forth hereinafter. Typically, the detergent composition will contain from about 1% to about 50% by weight of a detersive surfactant and from about 1% to about 75% by weight of a detergent builder.

In addition, the bleaching system that is in part made up by the bleach activator requires the presence of a peroxygen bleaching compound. Peroxygen bleaching compounds useful herein are those capable of yielding hydrogen peroxide in an aqueous liquor. These compounds are well known in the art and include hydrogen peroxide, the alkali metal peroxides, organic peroxide bleaching compounds such as urea peroxide, and inorganic persalt bleaching compounds, such as the alkali metal perborates, percarbonates, perphosphates, and the like. Mixtures of two or more such bleaching compounds can also be used, if desired. Preferred peroxygen bleaching compounds include sodium perborate, commercially available in the form of mono-, tri-, and tetra-hydrate, sodium pyrophosphate peroxyhydrate, urea peroxyhydrate, sodium percarbonate, and sodium peroxide. Particularly preferred are sodium perborate tetrahydrate, sodium perborate monohydrate and sodium percarbonate. Percarbonate is especially preferred because it is very stable during storage and yet still dissolves very quickly in the bleaching liquor. It is believed that such rapid dissolution results in the formation of higher levels of percarboxylic acid and, thus, enhanced surface bleaching performance. The peroxygen bleaching compound will comprise at least about 0.1%, preferably from about 1% to about 75%, more preferably from about 3% to about 40%, most preferably from about 3% to about 25%, by weight of bleaching system or detergent composition. The weight ratio of bleach activator to peroxygen bleaching compound in the bleaching system typically ranges from about 2:1 to 1:5. Preferred ratios range from about 1:1 to about 1:3. Such a bleaching system is described in more detail in U.S. Pat. No. 5,891,838, Angell, et al., issued Apr. 6, 1999.

The surfactant system of a detergent composition of the present invention may include anionic, nonionic, zwitterionic, ampholytic and cationic classes and compatible mixtures thereof. Detergent surfactants are described in U.S. Pat. No. 3,664,961, Norris, issued May 23, 1972, and in U.S. Pat. No. 3,919,678, Laughlin et al., issued Dec. 30, 1975, both of which are incorporated herein by reference. Cationic surfactants include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference.

Nonlimiting examples of surfactant systems include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y$ $(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the surfactant system. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

The detergent composition can, and preferably does, include a detergent builder. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above. Preferred for use herein are the phosphates, carbonates, silicates, $C_{10-18}$ fatty acids, polycarboxylates, and mixtures thereof. More preferred are sodium tripolyphosphate, tetrasodium pyrophosphate, citrate, tartrate mono- and di-succinates, sodium silicate, and mixtures thereof (see below).

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the nonsoap anionic surfactant.

Other suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2.M_2O$, M being an alkali metal, and having a $SiO_2$:$M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized, as well.

Any number of additional ingredients can also be included as components in the granular detergent composition. These include other detergency builders, suds boosters or suds suppressors, anti-tarnish and anti-corrosion agents, soil suspending agents, soil release agents, germicides, pH adjusting agents, nonbuilder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Suitable smectite clays for use herein are described in U.S. Pat. No. 4,762,645, Tucker et al., issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al., issued May 5, 1987, both incorporated herein by reference.

Having thus described the invention in detail, it will be obvious to those skilled in the art that various changes may be made without departing from the scope of the invention and the invention is not to be considered limited to what is described in the specification.

What is claimed is:

1. A granular bleach activator extrudate in the form of a substantially cylindrically-shaped particle having a mean extrudate length of from about 450 microns to about 3500 microns and a mean extrudate diameter of from about 450 microns to about 850 microns and having a geometric standard deviation of length between about 1.0 and 1.4, said bleach activator selected from the group consisting of:

a) activators having the general formula:

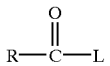

wherein R is an alkyl group containing from about 5 to about 18 carbon atoms, L is a leaving group;

b) benzoxazin-type bleach activators of the general formula:

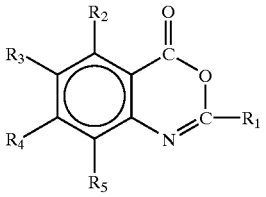

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkylamino, $COOR_6$ (wherein $R_6$ is H or an alkyl group) and carbonyl functions;

c) N-acyl caprolactam bleach activators of the formula:

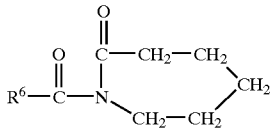

wherein $R^6$ is H or an alkyl, aryl, alkoxyaryl or alkaryl group containing from 1 to 12 carbons; and d) mixtures thereof.

2. The bleach activator extrudate of claim 1, wherein the bleach activator has the formula:

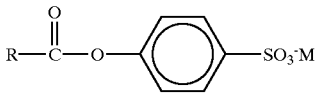

wherein R is an alkyl group containing from about 5 to about 9 carbon atoms and M is sodium or potassium.

3. The bleach activator extrudate of claim 2, wherein the activator is nonanoyloxybenzene sulfonate.

4. The bleach activator extrudate of claim 1, further comprising a binder material.

5. The bleach activator extrudate of claim 1, wherein said mean extrudate length is from about 450 microns to about 3000 microns.

6. The bleach activator extrudate of claim 5, wherein said mean extrudate length is from about 450 microns to about 2500 microns.

7. The bleach activator extrudate of claim 1, wherein said mean extrudate diameter is from about 500 microns to about 950 microns.

8. The bleach activator extrudate of claim 7, wherein said mean extrudate diameter is from about 550 microns to about 850 microns.

9. The bleach activator extrudate of claim 1, wherein the geometric standard deviation of the length of the extrudate is between about 1.0 and about 1.3.

10. The bleach activator extrudate of claim 9, wherein the geometric standard deviation of the length of the extrudate is between about 1.0 and about 1.2.

11. A granular detergent composition comprising, a detersive surfactant, a bleach activator extrudate according to claim 1 and a peroxygen bleaching compound.

* * * * *